United States Patent [19]

Leroy et al.

[11] 4,209,366

[45] Jun. 24, 1980

[54] PROCESS FOR IMPROVING THE SURFACE CLEANLINESS OF SHEET STEEL

[75] Inventors: Vincent M. Leroy; Joseph H. Richelmi, both of Liege, Belgium

[73] Assignee: Centre De Recherches Metallurgiques Centrum Voor Research In De Matallurgie, Brussels, Belgium

[21] Appl. No.: 920,799

[22] Filed: Jun. 30, 1978

[30] Foreign Application Priority Data

Jul. 1, 1977 [BE] Belgium ..... 856402

[51] Int. Cl.[2] ..... C25D 9/10; C25D 5/50

[52] U.S. Cl. ..... 204/27; 204/37 R; 204/56 R; 148/18; 148/28; 148/6.14 R

[58] Field of Search ..... 204/96, 98, 100, 37 R, 204/27–28, 35 N, 29, 56 R; 427/228, 301, 372, 402; 148/28, 15, 6.14 B, 18

[56] References Cited

U.S. PATENT DOCUMENTS

| | | | |
|---|---|---|---|
| 1,535,317 | 4/1925 | Koehnline | 148/28 |
| 3,632,487 | 1/1972 | Brown et al. | 204/34 |
| 3,671,335 | 6/1972 | Pavlik | 148/28 |
| 3,718,510 | 2/1973 | Patula et al. | 148/28 |

FOREIGN PATENT DOCUMENTS 1415394 11/1975 United Kingdom .

*Primary Examiner*—R. L. Andrews
*Attorney, Agent, or Firm*—Holman & Stern

[57] ABSTRACT

Before or during the coiling of cold-rolled sheet steel for stamping, the sheet steel is covered with a substance comprising an agent capable of reacting with amorphous carbon present on the sheet as a contaminant so as to form a volatile compound, such as carbon monoxide or carbon disulphide, during subsequent annealing of the coil. Suitable substances for forming carbon monoxide are (1) certain gels (e.g., gels deposited in the form of a very thin layer from a solution of a soluble silicate such as sodium, potassium, or lithium orthosilicate) which liberate water of adsorption on heating, as during annealing, which water of adsorption reacts with the carbon contaminant to form carbon monoxide; and (2) certain salts [e.g., $Ba(OH)_2$. $8H_2O$, $Ca(OH)_2$, and $Zr(OH)_4$] which liberate water of crystallization or water of constitution on heating, as during annealing, which waters of crystallization and constitution react with the carbon contaminant to form carbon monoxide. Suitable substances for forming carbon disulphide are thiourea, diethyl thiourea, and sulphonates.

7 Claims, No Drawings

PROCESS FOR IMPROVING THE SURFACE CLEANLINESS OF SHEET STEEL

The present invention relates to a process for improving the surface cleanliness of sheet steel and in particular sheet steel intended to be subjected to stamping operations such as are encountered in the automobile industry.

It is known that, in particular in the abovementioned applications, one of the essential conditions for the satisfactory use of these sheets is that the adherence of the products which, after the stamping of the sheets, have to be applied to the sheets to form coatings intended to protect them as long as possible against oxidation, depends essentially on the surface state of these sheets and in particular on their cleanliness.

Such factors are well-known and have been illustrated in particular by salt spray tests performed on phosphated, painted, and pre-scoured steel sheets, these tests being carried out according to AFNOR Standard 40.002. The behaviour with regard to the salt spray tests was better the cleaner the surface in question. In practice, a measurement of the surface cleanliness of a sheet is generally obtained by the adhesive tape removal test.

Tests carried out by means of recent surface analysis techniques such as for example ion microanalysis, have shown that the surface of an annealed and skin-passed stamping sheet was contaminated by the presence of iron fines and iron soaps, and by amorphous carbon resulting from incomplete distillation and partial cracking of the residues of scouring oil or rolling emulsion which were present on the sheet and which, on account of the fact that the sheet was wound into reels of closely packed turns, could not distil off freely during recrystallisation annealing.

The presence of this contamination in the form of amorphous carbon must not be confused with contamination due to the presence of carbon in the form of graphite appearing during annealing of sheets of white iron degreased electrolytically before annealing, such as described in U.S. Pat. No. 3,632,487 and in Dutch patent application No. 74.07528; the cause of this latter contamination is due to destabilisation, during recrystallisation annealing, of the cementite present in the sheet steel.

What is desired is a process for improving the cleanliness of annealed stamping sheets wound into coils of closely packed turns.

The present invention is based on the fact that it is possible to reduce the level of residual contamination by amorphous carbon by depositing on the surface of the cold-rolled sheet, before the sheet is wound into coils with closely packed turns, a chemical agent capable of reacting with the said carbon to form a volatile compound during annealing, such as for example carbon monoxide or carbon disulphide.

Among the agents that can be used to form the volatile compounds, there may in particular be mentioned: to form carbon monoxide: the water of adsorption of gels deposited in the form of a very thin layer on the sheet from a solution of a soluble silicate, for example sodium, potassium, or lithium silicate, or from tetraethanolammonium silicate or solutions of alkaline aluminate, or a mixture of these gels, the water of crystallisation or water of constitution of certain salts capable of liberating the said water at a high temperature, such as for example $Ba(OH)_2.8H_2O$, $Ca(OH)_2$, $Zr(OH)_4$;

to form carbon disulphide: substances such as thiourea, diethyl thiourea, and sulphonates.

These various substances may be applied in various ways, in particular by simple immersion in solutions or spraying solutions. However, in accordance with an advantageous procedure, before the application of the agent forming a volatile compound with the amorphous carbon, a gel having a porous surface is deposited on the surface of cold-rolled steel strip, preferably in a thickness not exceeding a few tens of Å (a few nanometers), the said gel being found to have a high bonding power for the aforementioned agent.

The deposition of the gel may be carried out for example by immersion or spraying with suitable nozzles at the outlet of the tandem rolls of the rolling mill, using a solution of a soluble silicate or aluminate of the type specified above, for example sodium orthosilicate. As regards operating practice, it has been found that rinsing carried out following the deposition of the gel and by means of water having a pH value of between 6.5 and 7.5 leads, within the minimum time, to the gelling of the layer thus deposited, and to the maximum deposition on the surface, all other factors remaining constant. In addition, it has been found that the presence of $Ca^{++}$ or $Mg^{++}$ ions in the water employed or $Fe^{++}$ ions on the surface being treated has a favourable effect.

According to another advantageous procedure, this gel may be obtained and deposited in a continuous manner by electrolysis, the strip in this case being kept charged alternately positive and negative with respect to the bath.

It is also within the scope of the invention to apply in succession to a stamping sheet first of all the gel deposit and then one or more of the agents producing volatile compounds with the amorphous carbon. The results obtained show that the effects of these treatments are cumulative. This treatment also covers the case where the surface carbon is in a form other than the amorphous form.

The effectiveness of these surface treatments considered individually or in combination can be illustrated more readily by means of some examples.

In these examples the determination of the overall surface contamination of the product was carried out by the adhesive tape removal test and by measuring the opacity of the tape with a densitometer, the opacity being expressed in arbitrary units. If by convention $\Delta U_1$, $\Delta U_2$, and $\Delta U_3$ denote the opacity of the adhesive tape on the strip in the cold rolled, pretreated, and annealed states respectively, then the various gain factors may be expressed thus:

$$G_{12} = \frac{\Delta U_1 - \Delta U_2}{\Delta U_1}, \quad G_{13} = \frac{\Delta U_1 - \Delta U_3}{\Delta U_1}, \text{ and } \quad G_{23} = \frac{\Delta U_2 - \Delta U_3}{\Delta U_2},$$

giving the degree of removal of the contamination during the various pretreatment and/or annealing stages.

EXAMPLE 1

Sheets of L.D. steel cold rolled with an emulsion of mineral oils were pretreated at 95° C. in various ways with a solution of sodium orthosilicate containing 25 g/l, namely by spraying at a rate of 1.5 kg/cm$^2$ for 10 seconds, by immersion for 3 seconds, and by electrolysis at a current density of 10 A/dm$^2$ for 3 seconds. The sheets were then rinsed in demineralised water and dried in hot air.

Measurements of the surface contamination were carried out after recrystallisation annealing, and the results are given in Table I.

Table I

| Reference number | Pretreatment | $\Delta U_1$ | $\Delta U_2$ | $\Delta U_3$ | $U_{13}$% |
|---|---|---|---|---|---|
| Ro 583/6 | — | 290 | | 151 | 48 |
| Ro 583/7 | $Na_2O . SiO_2$, immersion | 290 | 241 | 69 | 76 |
| E 62/12 | $Na_2O . SiO_2$, immersion | 121 | 103 | 22 | 82 |
| E 75 | $Na_2O . SiO_2$, spraying | 135 | 105 | 15 | 89 |
| Ro 609 | $Na_2O . SiO_2$, spraying | 65 | 45 | 15 | 77 |
| Ro 610 | $Na_2O . SiO_2$, spraying | 65 | 45 | 15 | 77 |
| Ro 583/8 | $Na_2O . SiO_2$, electrolysis | 290 | 72 | 14 | 95 |

EXAMPLE 2

Cold rolled sheets identical to those used in the previous example were pretreated at 95° C. with an orthosilicate solution containing 25 g/l, by immersion, spraying with nozzles, and by electrolysis. After rinsing in demineralised water at 25° C. and drying in hot air, the sheets were then immersed for 3 seconds in cyclohexane. The recrystallisation heat treatment was identical to that of the previous cases. The results of these tests are given in Table II.

Table II

| Reference number | Pretreatment | $\Delta U_1$ | $\Delta U_2$ | $\Delta U_3$ | $G_{13}$% |
|---|---|---|---|---|---|
| Ro 583/6 | — | 290 | | 151 | 48 |
| Ro 583/10 | $Na_2O . SiO_2$, immersion + $C_6H_{12}$, immersion | 290 | 318 | 91 | 69 |
| E 62/4 | $Na_2O . SiO_2$, immersion + $C_6H_{11}OH$, immersion | 121 | 115 | 33 | 73 |
| E 62 | $Na_2O . SiO_2$, immersion + $C_6H_{10}O$, immersion | 121 | 92 | 30 | 75 |
| Ro 583/11 | $Na_2O . SiO_2$, electrolysis + $C_6H_{12}$ | 290 | 163 | 8 | 97 |

EXAMPLE 3

Sheets identical to those used in Example 2 were treated at 95° C. with sodium orthosilicate by immersion for 10 seconds, and by electrolysis at a current density of 10 A/dm$^2$ for 3 seconds. The sheets were rinsed in both cases with demineralised water to which $10^{-1}$ M of thiourea had been added, and were then dried in hot air. Measurements of the surface contamination were carried out after recrystallisation annealing identical to that of the proceding cases, and the results obtained are given in Table III.

Table III

| Reference number | Pretreatment | $\Delta U_1$ | $\Delta U_2$ | $\Delta U_3$ | $G_{13}$% |
|---|---|---|---|---|---|
| Ro 583/6 | — | 290 | | 151 | 48 |
| Ro 583 | $Na_2O . SiO_2$, immersion + $NH_2$ CS $NH_2$ ($10^{-1}$M), immersion | 290 | 63 | 3 | 99 |
| Ro 583 | $Na_2O . SiO_2$, electrolysis + $NH_2$ CS $NH_2$ ($10^{-1}$ M) immersion | 290 | 146 | 3 | 99 |

We claim:

1. A process for improving the surface cleanliness of sheet steel for stamping, comprising:
   (a) winding the sheet steel into coils with closely-packed turns;
   (b) before or during the winding of the steel sheet into coils with closely-packed turns as set out in step (a), and prior to subsequent annealing, depositing a porous silicate on the sheet steel and applying to the sheet steel which is contaminated with carbon-containing material as substance comprising an agent capable of reacting with carbon present on the surface of the sheet as a contaminant so as to form a volatile carbon compound with said carbon contaminate during subsequent annealing of the closely-packed coils of the sheet steel, said silicate thereafter gelling, holding said agent to react with the carbon;
   (c) annealing the closely-packed coils of the sheet steel treated as in step (b) whereby the carbon contaminate is converted into a volatile carbon compound by reaction with said agent and is removed, thereby producing a sheet steel having a surface of enhanced cleanliness in being essentially carbon-free; and
   (d) subjecting the sheet steel having a carbon-free surface obtained in step (c) to stamping operations.

2. The process as claimed in claim 1, in which the silicate is deposited by immersion or spraying at the outlet of a rolling mill, deposition then being followed by rinsing in water.

3. The process as claimed in claim 2, in which the silicate is deposited in the form of a solution of a soluble silicate or aluminate.

4. The process as claimed in claim 3, in which the soluble silicate is sodium ortho-silicate.

5. The process as claimed in claim 2, in which the deposition of the silicate is followed by rinsing with water having a pH value of between 6.5 and 7.5.

6. The process as claimed in claim 1, in which the porous silicate is deposited to a thickness of not more than a few nanometres.

7. The process as claimed in claim 1, in which the silicate is obtained and deposited in a continuous manner by electrolysis, the sheet steel being charged alternately positive and negative with respect to the bath.

* * * * *